US005343795A

United States Patent [19]

Ziemba et al.

[11] Patent Number: 5,343,795

[45] Date of Patent: Sep. 6, 1994

[54] SETTABLE ELECTRONIC FUZING SYSTEM FOR CANNON AMMUNITION

[75] Inventors: Richard T. Ziemba, Burlington; David G. Hoyt, Milton, both of Vt.

[73] Assignee: General Electric Co., Burlington, Vt.

[21] Appl. No.: 788,911

[22] Filed: Nov. 7, 1991

[51] Int. Cl.[5] ..... F42C 17/04

[52] U.S. Cl. ..... 89/6.5; 102/215

[58] Field of Search ..... 89/6, 6.5; 102/206, 102/215, 216

[56] References Cited

U.S. PATENT DOCUMENTS

| | | | |
|---|---|---|---|
| 3,371,579 | 3/1968 | Kinzelman | 89/6 |
| 3,500,746 | 3/1970 | Ambrosini | 102/70.2 |
| 3,646,371 | 2/1972 | Flad | 102/215 |
| 3,670,652 | 6/1972 | Ziemba | 102/70.2 P |
| 3,714,898 | 2/1973 | Ziemba | 102/70.2 R |
| 3,760,732 | 9/1973 | Schuster et al. | 102/70.2 R |
| 3,777,665 | 12/1973 | Ziemba | 102/70.2 P |
| 3,844,217 | 10/1974 | Ziemba | 102/70.2 R |
| 4,022,102 | 5/1977 | Ettel | 89/6.5 |
| 4,026,215 | 5/1977 | Ziemba et al. | 102/70.2 R |
| 4,044,680 | 8/1977 | Ziemba | 102/70.2 R |
| 4,083,308 | 4/1978 | Levis | 102/206 |
| 4,142,442 | 3/1979 | Tuten | 89/6.5 |
| 4,144,815 | 3/1979 | Cumming et al. | 102/214 |
| 4,254,475 | 3/1981 | Cooney et al. | 102/215 |
| 4,267,776 | 5/1981 | Eickerman | 102/215 |
| 4,387,649 | 6/1983 | Weidner et al. | 102/215 |
| 4,495,851 | 1/1985 | Koerner et al. | 89/6.5 |
| 4,577,561 | 3/1986 | Perry | 102/215 |
| 4,649,796 | 3/1987 | Schmidt | 89/6.5 |
| 4,862,785 | 9/1989 | Ettel et al. | 89/6.5 |
| 4,955,279 | 9/1990 | Nahrwold | 89/6.5 |

*Primary Examiner*—Charles T. Jordan
*Attorney, Agent, or Firm*—S. A. Young

[57] ABSTRACT

In an ammunition fuzing system, a fuze setter is inductively coupled with an electronic fuze incorporated in the projectile of an ammunition round being fed to a rapid-fire cannon to transmit power supply charging energy and fuze-setting data thereto. A detonation counter is incremented at a high counting rate to accumulate a projectile flight time count indicative of the fuze-setting data. A conformation signal is transmitted to the fuze setter for determination that the flight time count acceptably corresponds to the setting data. Upon projectile launch, the detonation counter is decremented at a low counting rate and functions the projectile warhead when decremented to zero.

20 Claims, 5 Drawing Sheets

SETTABLE ELECTRONIC FUZING SYSTEM FOR CANNON AMMUNITION

The present invention relates to ordnance systems and particular to an improved electronic fuze system for rapid-fire cannon ammunition.

BACKGROUND OF THE INVENTION

Electronic fuzing systems for controlling the detonation of a projectile warhead are well-known in the art. One approach is to utilize projectile-borne sensors of various types, e.g., radar, infra-red, electrostatic, etc., for signalling an electronic fuze to detonate the warhead when the projectile is proximate the target. A variant of this approach is to signal the electronic fuze to detonate the warhead via a microwave link when fire control radar determines that the projectile is within killing range of the target.

Another approach is to determine target range using, for example, a radar or laser range finder, and then set the electronic fuze for an appropriate time-of-flight based on the determined target range. Once the projectile is fired, the electronic fuse counts out the flight time and detonates the warhead when the pre-set time-of-flight expires. Timed fuze detonation, rather that impact or point detonation (PD), is more effective for some targets, such as entrenched ground troops, where warhead detonation while the projectile is overhead will typically have more devastating effects.

One extremely important consideration in setting electronic fuzes is the setting time required, particularly with the current emphasis on rapid-fire cannons. Thus, entering the time-of-flight information into the electronic fuze must be accomplished during an extremely short time window so as not to jeopardize firing rate. Moreover, the setting information must be accurately registered in the electronic fuze, otherwise that projectile becomes a "dud" insofar as the intended target is concerned. Various techniques have been utilized for entering the time-of-flight data from the fuze setter into the fuze, including microwave links to enter this data while the projectile is in flight to the target or travelling down the gun barrel, or inductive coupling links also while the projectile transits the gun barrel. Alternative, a wire data link between the fuze setter and the fuze has been employed.

SUMMARY OF THE INVENTION

It is accordingly an object of the present invention to provide an improved electronic fuzing system for cannon ammunition, wherein an electronic fuze can be readily set to operate in several selected detonating modes depending on the nature of the target. Fuze setting is accomplished expeditiously prior to the ammunition rounds being loaded into a rapid-fire cannon without sacrificing firing rate. The electronic fuze is preconditioned to a point detonation (PD) mode which prevails if no time-of-flight data is set into the fuze or the entry of such fuze-setting data is determined to be in error. With the entry of setting data, the electronic fuze functions in a timed detonation (TD) mode, either to explode the projectile in proximity to the target (air burst) or to self-destruct (SD) the projectile in the event a target is not impacted to function the fuze in the TD mode.

To achieve these objectives, the present invention comprises a fuze setter which includes a transmitter for driving an induction coil to transmit projectile time-of-flight data. An electronic fuze incorporated in the projectile of each of a succession of ammunition rounds includes an induction coil which becomes magnetically linked with the fuze setter induction coil as each round transits a coupling zone in the ammunition feedpath to a rapid-fire cannon. The time-of-flight data is coupled into the electronic fuze, and a detonation counter is incremented at a high counting rate to a projectile flight time count indicative of the time-of-flight data. When a round is fired, the detonation counter of its fuze is decremented at a low counting rate and, upon reaching a zero count, functions the projectile warhead in the TD mode.

To confirm that the time-of-flight data was correctly received, a conformation signal indicative of the flight time count accumulated in the detonation counter is transmitted back to the fuze setter. If a correspondence between the flight time count and the transmitted time-of-flight data is found to exist, the fuse setter conditions the fuze to the TD mode prior to projectile firing. If not, the fuze setter leaves the electronic fuze in the PD mode. In addition to transmitting time-of-flight data, the fuze setter transmits bursts of electrical energy to charge up a power supply in the fuze, which then powers up the fuze electronics to accept the time-of-flight data and to then count off the projectile flight time, if the fuze setter determines that the time-of-flight data was correctly entered in the detonation counter. To condition a self-destruct (SD) mode, a flight time count is entered in the detonation counter in excess of the target range, and thus the warhead is functioned in the SD mode, unless the target is impacted to function the warhead in the PD mode.

The invention accordingly comprises the features of constructions, combinations of elements and arrangements of parts, all as detailed hereinafter, and the scope of the invention will be indicated in the claims.

BRIEF DESCRIPTION OF THE DRAWINGS

For a full understanding of the nature and objects of the invention, reference may be had to the following Detailed Description taken in conjunction with the accompanying drawings, in which.

Corresponding reference numerals refer to like parts throughout the several views of the drawings.

DETAILED DESCRIPTION

Figure 1:
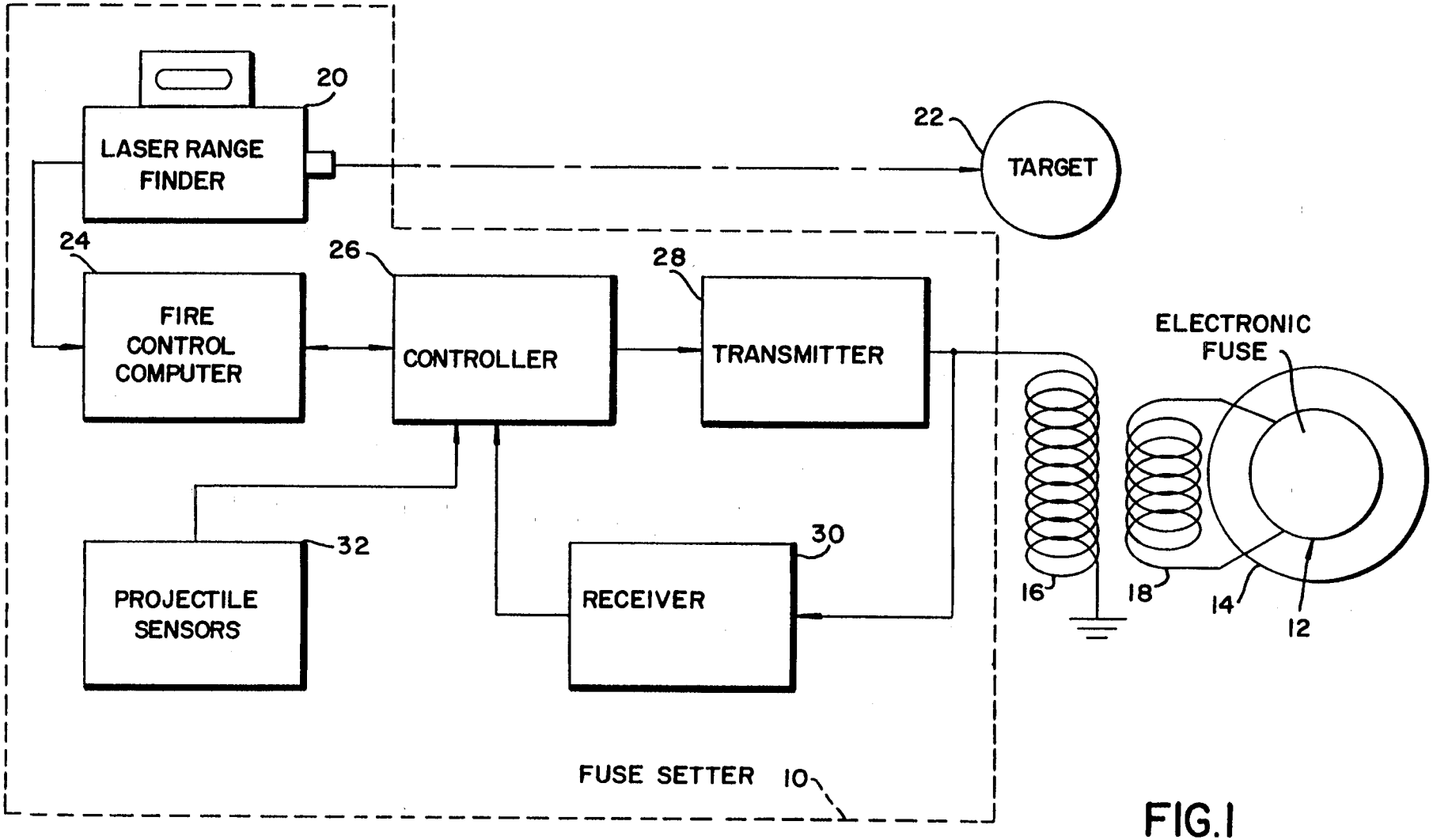
FIG. 1 is a circuit block diagram of an ammunition electronic fuzing system constructed in accordance with the present invention.

The electronic fuzing system of the present invention includes, as seen in FIG. 1, a fuze setter, generally indicated at 10, and an electronic fuze, generally indicated at 12 and incorporated in an ammunition round 14. Communication between the fuze setter and the electronic fuze is provided by a magnetic coupling link between an induction coil 16 driven by the fuze setter and an induction coil 18 driven by the electronic fuze. The fuze setter is seen to include a range finder 20, such as a laser range finder, which is sighted on a target 22. Target range information developed by the range finder is sent to a fire control computer 24, which solves the projectile ballistics equation to produce a time-of-flight solution for the sighted target. This solution, in the form of projectile time-of-flight data, is communicated to a controller 26 which then triggers a transmitter 28, in the form of a oscillator, to generate a burst of timing pulses at suitably high transmission frequency, e.g. 100 KHz. The number of timing pulses in the burst, i.e., the burst interval, constitutes a conversion of the time-off-flight data by the controller and thus provides a direct representation thereof. This timing pulse burst drives induction coil 16 and is communicated to the electronic fuze via induction coil 18 while the two coils are linked in magnetically coupled relation. The fuze setter also includes a receiver 30 enabling the electronic fuze to communicate with controller 26 while the induction coils are magnetically linked. Projectile sensors 32 indicate to the controller when the induction coils are linked and thus when communication between the fuze setter and the electronic fuze can take place.

Figure 2:
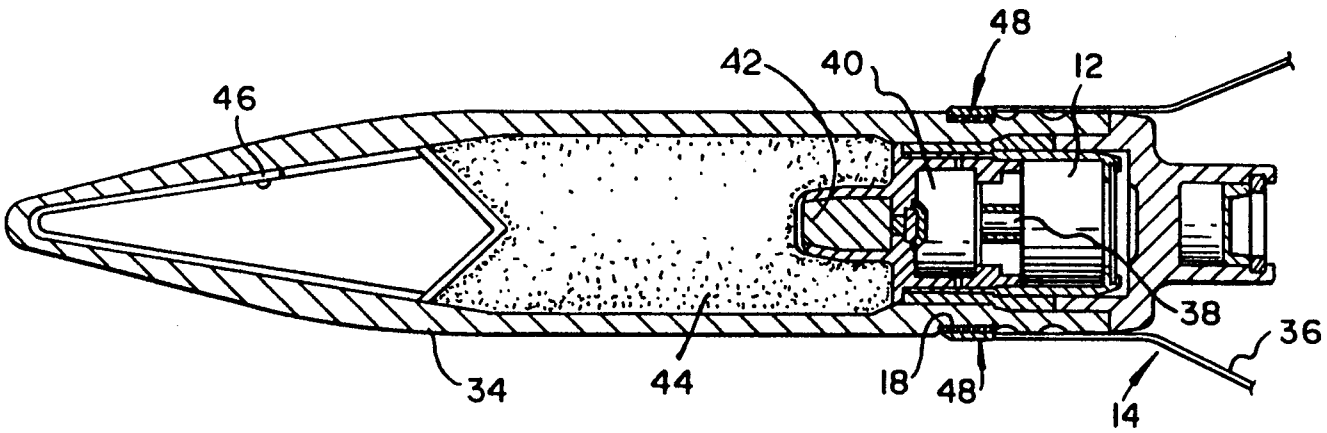
FIG. 2 is a fragmentary longitudinal sectional view of an ammunition round incorporating the electronic fuze included in the system of FIG. 1.

As seen in FIG. 2, each ammunition round 14 includes a projectile 34 and a casing 36. Incorporated within the projectile are electronic fuze 12, an igniter or detonator 38, a safing and arming device 40, a booster charge 42, an explosive warhead 44, and an impact switch 46 for PD mode warhead functioning. The safing and arming device may be of a conventional design to include a rotor ball which is equipped with a spin latch to prevent the rotor ball from assuming an orientation aligning its explosive charge passage with the detonator and booster until after the projectile is well along in its flight. Explosion of the projectile is achieved when the electronic fuze triggers the ignition of detonator 38, which sets off the rotor ball charge, the booster charge and then the warhead in rapid chain reaction. Induction coil 18 is seen in FIG. 2 to be coiled about a cylindrical portion of the steel projectile body, preferably at a location beneath a molded plastic rotating band 48.

Figure 3:
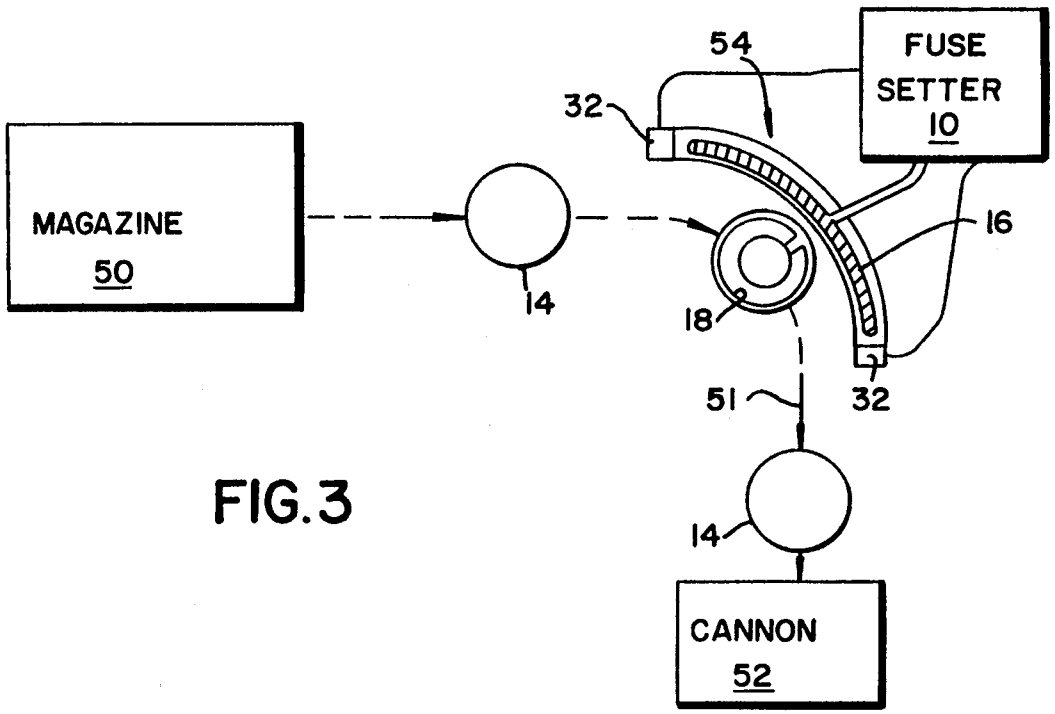
FIG. 3 is a schematic diagram illustrating implementation of the system of FIG. 1 to ammunition rounds moving along a feedpath from a magazine to a rapid-fire cannon.

In accordance with a feature of the present invention, setting of the electronic fuze, i.e., entering the time-of-flight data therein, is effected prior to the firing of the ammunition rounds, in fact, prior to the rounds being loaded in a rapid-fire cannon. Thus, as seen in FIG. 3, ammunition rounds 14 are fed from a magazine 50 along a feed path 51 to a rapid-fire cannon 52. Stationed at a convenient location along this feedpath, such as at a 90° turn, is a coupling zone, generally indicated at 54, for accommodating fuze setter induction coil 16. Projectile sensors 32 signal controller 26 of FIG. 1 as each ammunition round enters and then exits the coupling zone. In the interval between these sensor signals, the setter coil 16 and fuze coil 18 of each round are in contiguous, tight transformer coupled relation to accommodate back and forth communication as the round progresses through the coupling zone.

Figure 4:
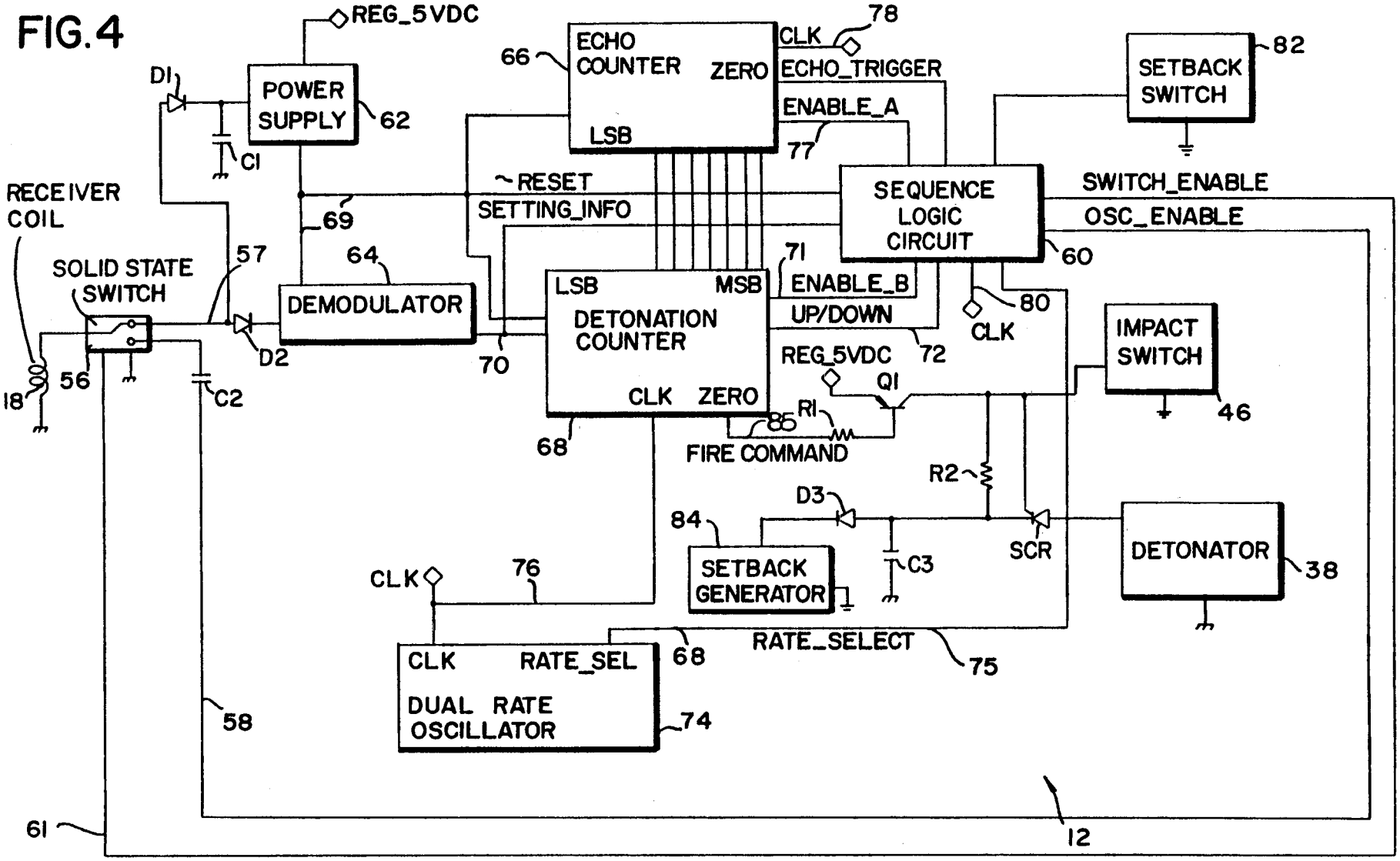
FIG. 4 is a circuit schematic, partially in block diagram form, of an electronic fuze in FIG. 1, which is constructed in accordance with one embodiment of the invention.

In the embodiment of the electronic fuze 12 seen in FIG. 4, induction coil 18 is connected to ground at one end, with its other end connected to a send/receive solid state switch 56. This switch is converted between its receive condition connecting the coil to line 57 and its send condition connecting the coil to line 58 by a signal from sequence logic circuitry 60 over line 61. In the receive condition, positive half cycles of the signals coupled into coil 18 are passed by diode D1 to charge a power supply 62 and by diode D2 as time-of-flight data to a demodulator 64.

Figure 5:
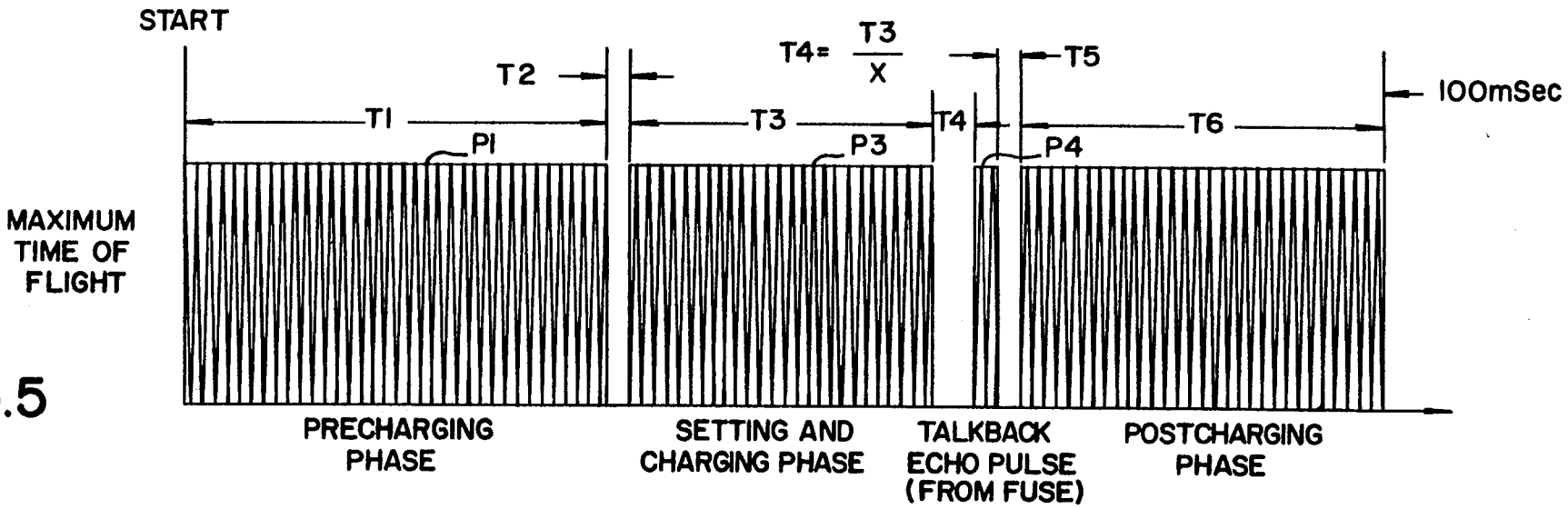
FIG. 5 is a signal diagram illustrating the operation of the electronic fuze in FIG. 4.

Turning to FIG. 5, prior to sending the burst of time-of-flight timing pulses P3 during a period T3, the fuse electronics must be powered up. Thus, upon entry of an ammunition round into coupling zone 54 (FIG. 3), controller 26 of the fuze setter activates transmitter 28 to send a burst of energy pulses P1 during a period T1. These energy pulses are routed through switch 56 in its receive condition and diode D1 to charge an energy storage capacitor C1 for a power supply 62. By the conclusion of period T1, capacitor C1 is brought up to full charge, enabling the power supply to provide a regulated positive DC supply voltage of, for example 5 volts. During a deadband interval T2, the power supply initializes or resets sequence logic circuitry 60, demodulator 64, an echo counter 66, and a detonation counter 68 over leads 69.

With the fuze electronics fully powered up from the power supply, the fuze is prepared to receive the burst of timing pulses P3 over the period T3, the length of which being representative of the time-of-flight data derived for the sighted target. Upon receipt of the initial timing pulse through diode D2 by demodulator 64, which is in the form of a one-shot multivibrator, its output on line 70 goes high and stays high as long as timing pulses are received. Thus, the output of the demodulator is in the form of a single pulse whose length is precisely equal to the period T3. This demodulator pulse is applied to the sequence logic circuit, which, in response, concurrently enables the detonation counter over lead 71, conditions the detonation counter to the countup mode over lead 72, and triggers a dual rate oscillator 74 over lead 75 to generate high frequency clock pulses over lead 76 to the clock input of the detonation counter. Thus during the period T3, the detonation counter is incremented by each of these high frequency clock pulses. At the conclusion of period T3, the detonation counter registers an accumulated clock pulse count representative of the T3 period length and thus constitutes a projectile flight time count representing the time-of-flight data transmitted by the fuze setter. It will be noted that, during this fuze setting phase T3, the received timing pulses are also utilized to continue charging the power supply.

To confirm that the flight time count corresponds to the time-of-flight data, the contents of the last seven stages of the ten-stage detonation counter are continuously read in parallel into the seven stages of echo counter 66, such that three least significant bits of the count in the detonation counter are truncated from the count in the echo counter. At the conclusion of the period T3, the sequence logic circuit responds to the falling edge of the demodulator output pulse by enabling the echo counter over line 77 to begin a countdown of high frequency clock pulses applied on lead 78 from oscillator 74. When the echo counter is decremented to zero, a trigger signal is issued over lead 77 to the sequence logic circuit. In response, the sequence logic circuit gates a short burst of high frequency clock pulses provided by the oscillation on lead 80 out onto line 58 and through capacitor C2 to switch 56 which was previously switched to its send condition. This pulse burst, indicated at P4 in FIG. 5, is coupled back as an echo signal into the fuze setter and to the controller via the magnetically linked induction coils and receiver 30 (FIG. 1). The interval between the last clock pulse P3 and the first clock pulse P4 defines a period T4 whose length is proportioned to the flight time count residing in the detonation counter divided by a binary factor determined by the truncated count residing in the echo counter at the conclusion of period T3. Since, in the illustrated embodiment, the three least significant bits were truncated, this binary division factor (X) is eight. Thus, the controller multiplies the detected length of period T4 by this binary division factor. If the resulting product substantially corresponds to the length of period T3, the controller has conformation that the detonation counter did indeed count high frequency clock pulses throughout period T3, and thus the transmitted time-of-flight data is accurately replicated in the detonation counter as a projectile flight time count.

It will be appreciated that providing a conformation signal back to the fuze setter in the form of a variable deadband period T4 reduces fuze power requirements, since the echo pulse burst need include only one or several pulses P4 at the most. Moreover, truncating the flight time count in the echo counter dramatically reduces the time required to formulate a confirmation signal for transmission back to the fuze setter. Since the fuze is set while the ammunition round is on the move through the coupling zone, abbreviation of the fuze setting and setting conformation times is a very important consideration.

If the conformation signal indicates that the fuze has been correctly set, the fuze setter generates a final burst of timing or energy pulses P6 to recharge the power supply capacitor during a period T6 and thus prepare the electronic fuze for flight.

When an ammunition round is fired off by the cannon to launch its projectile, an inertial setback switch 82 closes to apply a ground potential signal to the sequence logic circuit. In response, the sequence logic circuit enables the detonation counter over line 71, conditions the detonation counter in the countdown mode over line 72, and conditions the oscillator 74 over line 75 to begin issuing low frequency clock pulses over lead 76 to the detonation counter. The detonation counter thus begins counting low frequency clock pulses down from the flight time count residing therein at the conclusion of period T3.

Also coincident with projectile launch, a setback generator 84 generates a large negative pulse which passes through diode D3 to charge a firing capacitor C3. This setback generally may be of the construction described in U.S. Pat. No. 3,844,127 to include a permanent magnet and an induction coil. In response to projectile launch, the magnet is propelled by inertial forces through the coil to generate the large firing capacitor charging pulse.

When the detonator counter has been decremented to zero by the low frequency clock pulses, a fire command signal appears on lead 85 connected to the base of a transistor Q1 through a resistor R1. This transistor turns on to apply via its emitter-collector circuit, the positive supply voltage to the gate of a silicon controlled rectifier SCR. This SCR is triggered into conduction to discharge the firing capacitor into detonator 38, thereby functioning the projectile warhead in the TD mode. If the projectile impacts an object before the detonation counter is decremented to zero, impact switch 46 closes to ground, and the resulting initial discharge of firing capacitor C3 develops a gate triggering voltage across resistor R2. The SCR is then gated into conduction to fully discharge the firing capacitor into the detonator to explode the projectile. It is thus seen that the fuze setter can leave the electronic fuze in a defaulted PD mode simply by not setting the fuze. If a SD mode is called for the fuze setter merely sets the fuze to a flight time count in excess of the detected target range. If the target is missed, the projectile is destroyed when the detonation counter is zeroed at some point beyond the target.

It will be appreciated that, by utilizing dual rate oscillator 74 to increment the detonation counter at a high clock pulse rate to a flight time count representative of the fuze-setting time-of-flight data transmitted to the fuze and then to decrement the detonation counter to zero at a low clock pulse rate, the fuze setter does not need to know the precise time base of this oscillator when formulating the time-of-flight data, as long as it takes into account the known inherently fixed frequency relationship between the high and low clock pulse rates. Thus, the time to count down the detonation counter to zero will conform to the fuze-setting time-of-flight data with acceptable accuracy. Moreover, the high frequency countup and low frequency countdown of the detonation counter permits a substantial compression of the fuze setting time.

Figure 7:
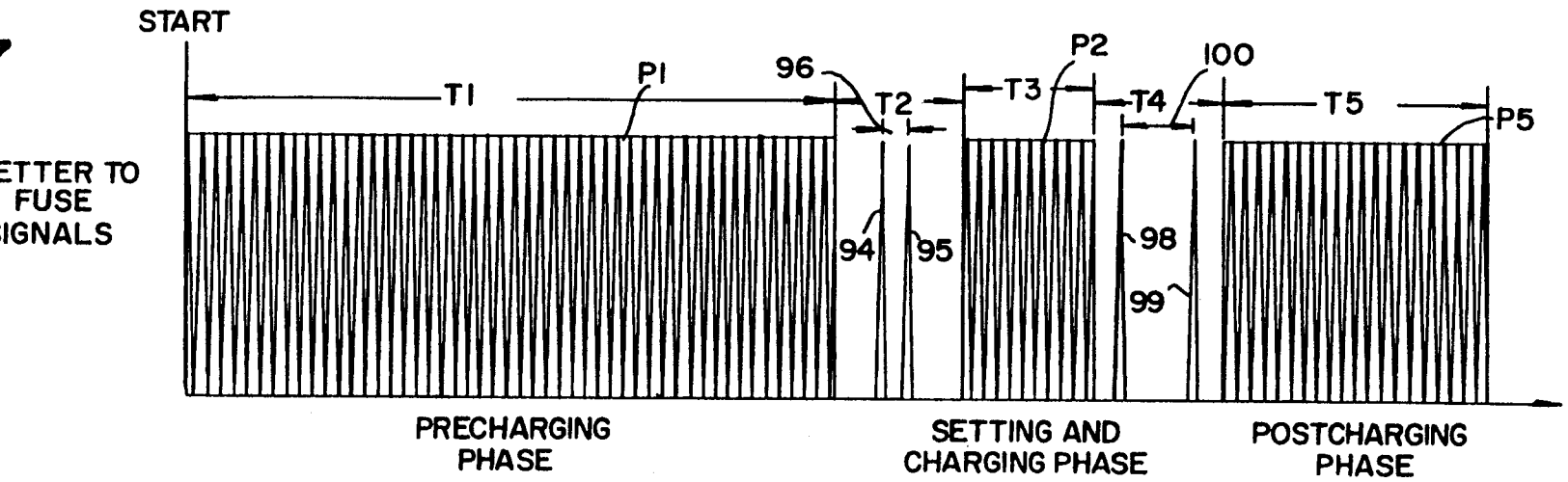
FIG. 7 is a signal diagram illustrating the operation of the electronic fuze in FIG. 6.
Figure 6:
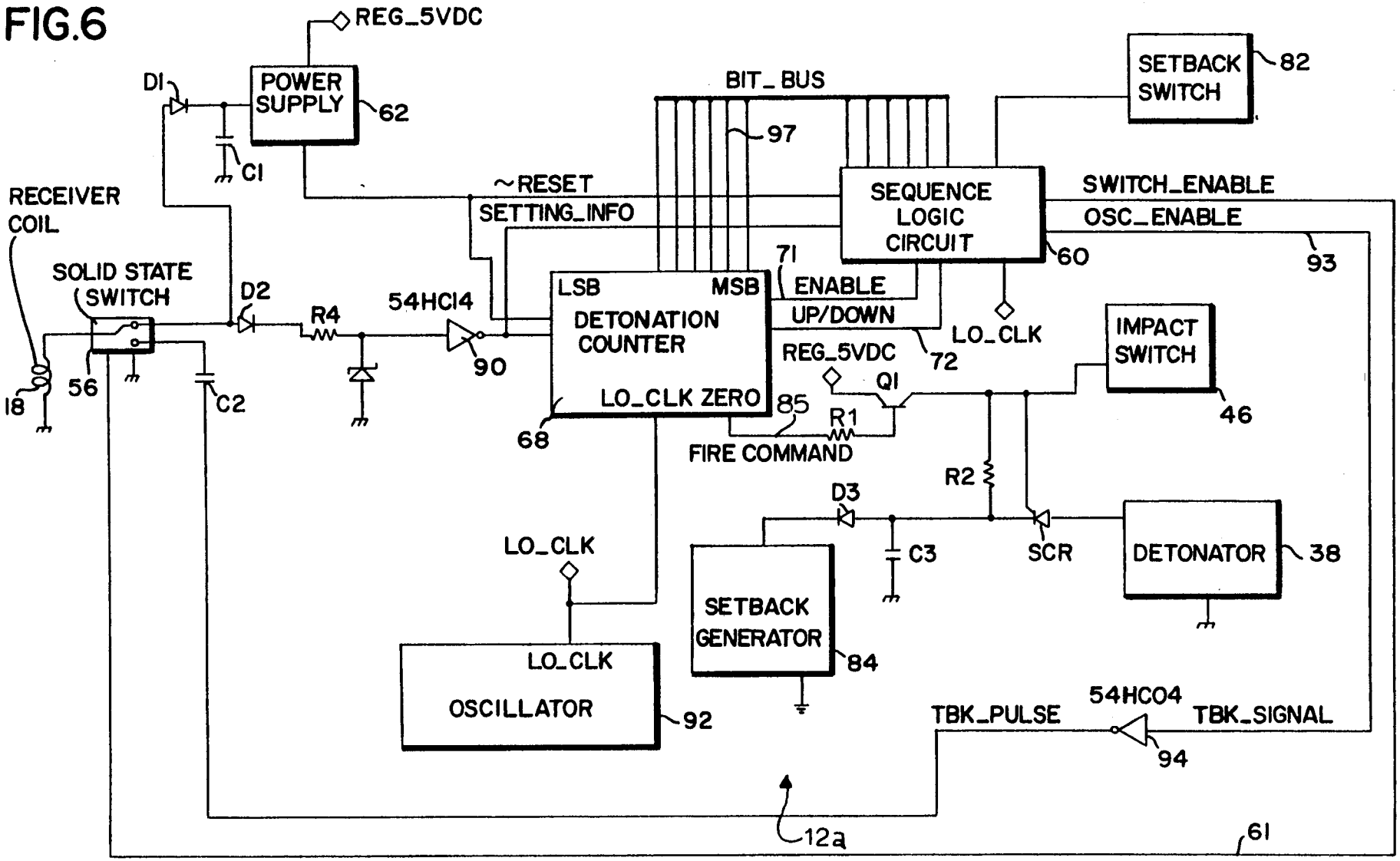
FIG. 6 is a circuit schematic, partially in block diagram form, of an electronic fuze in FIG. 1, which is constructed in accordance with an alternative embodiment of the present invention.

The alternative electronic fuze embodiment, generally indicated at **12*a* in FIG. 6, differs from the embodiment 12 of FIG. 4 in respect to the manner in which the detonation counter is incremented and in the formulation of the fuze setting conformation signal. The vast majority of the elements in the two embodiments correspond and thus are indicated by the same reference numerals. The fuze setter powers up the electronics of fuze 12*a* in the same manner by transmitting a burst of energy pulses P1 over a precharging period T1 (FIG. 7), which charges storage capacitor C1 of power supply 62. When the power supply voltage goes into regulation, sequence logic circuit 60 and detonation counter 68 are reset (initialized). In contrast to fuze 12 of FIG. 4, the detonation counter in fuze 12*a* actually counts the number of high frequency timing pulses representing the time-of-flight data transmitted by the fuze setter. Thus, it is seen in FIG. 6 that these pulses received by fuze 12*a* are applied to the detonation counter via switch 56, diode D2, resistor R4 and a pulse shaper 90. On the leading edge of the first pulse, the sequence logic circuit enables the detonation counter to be incremented by each timing pulse P3 received over the period T3 (FIG. 7). Thus, the detonation counter counts up to a flight time count which is equal to the number of timing pulses P3. The fuze setter likewise transmits a burst of energy pulses P5 during a period T5 (FIG. 7) to recharge storage capacitor C1 in preparation for projectile launch. When an ammunition round is fired off, as signalled by setback switch 82, the sequence logic circuit conditions the detonation counter to the countdown mode and to begin counting low frequency clock pulses generated by an oscillator 92. When the detonation counter is counted down to zero, the SCR is gated into conduction to discharge the setback generator charged firing capacitor C3 into the detonator to function the warhead in the TD mode, all in the manner described above in the case of fuze 12**.

However, in contrast to the fuze 12 embodiment, the fuze setter, in order to correctly formulate the time-of-flight data, i.e., determine the correct number of data pulses P2 for transmission to fuze 12*a*, must know the time base of oscillator 92. To provide this information, during the period T2 between periods T1 and T3 in FIG. 7 the sequence logic circuit sends a calibration signal in the form of a single low frequency clock pulse via line 93 and pulse shaper 94 to switch 56 which has been put in its send condition. In response to this shaped clock pulse, induction coil 18 and capacitor C2 act to develop a first pulse P3 on the leading pulse edge and a second pulse 95 on the trailing pulse edge. Knowing the duty cycle of the fuze oscillator, the controller in the fuze setter then can determine the frequency of the low clock pulses from the interval 96 between pulses 94 and 95. Now knowing the frequency of the detonator counter countdown clock pulses, the controller can accurately formulate the time-of-flight data for transmission to the fuze.

To provide an acceptable conformation that the time-of-flight data pulses were fully accumulated in the detonation counter during period T3, the content of the last six stages of the detonator counter are sensed by the sequence logic circuit over lines 97 to determine which of these stages contains the most significant bit of the flight time count registered in the counter. Based on this determination, the sequence logic circuit sends a pair of oscillator clock pulses 98 and 99 (FIG. 7) to the fuze setter during period T4, with the interval 100 between pulses set to indicate the most significant bit location in the detonation counter. The fuze setter controller detects the confirmation signal pulse interval to determine that the indicated most significant bit location in the detonation counter is proper for the particular time-of-flight data transmitted to the fuze. If so, there is an acceptable conformation that the detonation counter counted all of the data pulses, and thus the flight time count residing therein is accurate for the sighted target. The fuze setter then generates the burst of energy pulses P5 over the period T5 to recharge storage capacitor C1 preparatory to launch. It will be understood that the time periods in FIG. 7 are not indicated in accurate relative time scale to facilitate illustration and that the pulses 98 and 99 represent either the leading or trailing edges of the time spaced clock pulses.

It is seen from the foregoing that the objectives of the invention are efficiently attained, and, since certain changes may be made in the constructions set forth without departing from the invention, it is intended that matters of detail be taken as illustrative and not in a limiting sense.

Having described the invention, what is claimed is new and desired to secure by Letters Patent is:

1. A system for setting a projectile fuse of each of a succession of ammunition rounds being fed to a rapid-fire cannon, said system comprising, in combination:

A. a fuze setter including
  1) a controller,
  2) a transmitter connected with said controller, and
  3) a first inductive coil connected with said transmitter and located in a coupling zone situated along an ammunition round feedpath leading to the cannon; and B. an electronic fuze incorporated in the projectile of each ammunition round and including
  1) a second inductive coil assuming an inductively coupled relationship with said first inductive coil during movement along the ammunition round feedpath through said coupling zone, so as to receive time-of-flight data transmitted by said transmitter under the control of said controller,
  2) first means for registering a projectile flight time count indicative of said time-of-flight data,
  3) a detonator,
  4) second means for timing the flight of the projectile, and
  5) third means for triggering said detonator to explode the projectile when the projectile flight time achieves correspondence with said flight time count.

2. The system defined in claim 1, wherein said fuze setter further includes a receiver connected with said controller and said first induction coil, and said electronic fuse further including fourth means for formulating a conformation signal for transmission back to said controller via said first and second induction coils and said receiver to confirm that said flight time count registered in said first means substantially corresponds to said time-of-flight data transmitted by said transmitter.

3. The system defined in claim 1, wherein said fuze setter further includes a sensor responsive to the entry of said second induction coil into said coupling zone for signalling said controller to begin sending said time of flight data via said transmitter.

4. The system defined in claim 3, wherein said second inductive coil is located at a substantially cylindrical portion of the projectile so as to maximize the magnetic coupling with said first induction coil while said second induction coil is in said coupling zone.

5. The system defined in claim 2, wherein said electronic fuze further includes a power supply having a storage capacitor, said controller controlling said transmitter to transmit a first burst of electrical energy for charging said storage capacitor prior to transmitting said time-of-flight data and to transmit a second burst of electrical energy for recharging said storage capacitor when said conformation signal indicates substantial correspondence between said time-of-flight data and said flight time count.

6. The system defined in claim 5, which further includes an impact switch for triggering said detonator to explode the projectile upon impact with an object prior to the triggering of said detonator by said third means.

7. The system defined in claim 2, wherein said first means includes a detonation counter, said detonation counter being incremented at a high frequency rate to count up to said projectile flight time count, and said second means includes an oscillator for generating clock pulses to decrement said detonation counter at a low frequency rate, said detonation counter initiating triggering of said detonator by said third means upon being counted down to zero.

8. The system defined in claim 7, wherein said time-of-flight data is transmitted to said fuze in the form of a burst of timing pulses over a period whose length is indicative of said time-of-flight data, and wherein said fuze further includes a source of high frequency clock pulses and a logic circuit responsive to said timing pulse burst for conditioning said detonation counter to count said high frequency clock pulses over the length of said period, whereby to increment said detonation counter to said flight time count.

9. The system defined in claim 8, wherein said oscillator is a dual frequency oscillator for generating said high and low frequency clock pulses to increment and decrement said detonation counter under the control of said logic circuit, the frequency relationship between said high and low frequency clock pulses being fixed.

10. The system defined in claim 9, wherein said fourth means and said logic circuit formulate said conformation signal as at least one echo pulse transmitted back to said controller to mark a time period having a duration indicative of said flight time count registered in said detonation counter.

11. The system defined in claim 10, wherein said echo pulse is transmitted back to said controller in time spaced relation to the conclusion of said timing pulse burst transmitted to said fuze.

12. The system defined in claim 11, wherein said fourth means includes an echo counter connected with said detonator counter to register a truncated count of said flight time count, upon the conclusion of said timing pulse burst, said echo counter being decremented by said high frequency clock pulses to count down to zero from said truncated count and thereupon to signal said logic circuit to transmit said echo pulse.

13. The system defined in claim 2, wherein said time-of-flight data is transmitted to said fuze in the form of a burst of high frequency timing pulses in number indicative of said time-of-flight data, and wherein said first means includes a detonation counter conditioned to count the number of timing pulses in said burst and to thereby register said flight time count, and said second means includes an oscillator for generating low frequency clock pulses to decrement said detonation counter, said detonation counter initiating triggering of said detonator upon being counted down to zero.

14. The system defined in claim 13, wherein said fourth means includes a logic circuit for transmitting a calibration signal to said controller prior to the transmission of said timing pulse burst, said calibration signal being indicative of the frequency of said clock pulses.

15. The system defined in claim 14, wherein said calibration signal is in the form of a pair of calibration pulses transmitted coincident with the leading and trailing edges of one of said clock pulses.

16. The system defined in claim 15, wherein said logic circuit is connected with said detonation counter to detect the location of the most significant bit of said flight time count in said detonation counter, said logic circuit transmitting said conformation signals as a pair of echo pulses at a selected interval indicative of said most significant bit location.

17. An ammunition fuzing system comprising, in combination:

A. a fuze setter including 1) a controller,
2) a transmitter connected with said controller,
3) a receiver connected with said controller, and
4) a first inductive coil connected with said transmitter and receiver; and B. an electronic fuze incorporated in an ammunition round projectile and including 1) a power supply including an energy storage capacitor,
2) a second inductive coil for receiving, while in inductively coupled relationship with first inductive coil, a burst of energy pulses for charging said capacitor followed by time-of-flight data as transmitted by said transmitter under the control of said controller,
3) a detonation counter for accumulating at a high counting rate a projectile flight time count indicative of said time-of-flight data,
4) a logic circuit for formulating a conformation signal indicative of said flight time count and transmitting said conformation signal back to said controller for conformation that said flight time count acceptably corresponds to said time-of-flight data,
5) a detonator,
6) an oscillator for generating clock pulses, said detonation counter counting said clock pulses down from said flight time count at a low counting rate, and
7) means for triggering said detonator to explode the projectile when said detonation counter is counted down to zero.

18. The ammunition fuzing system defined in claim 17, wherein said time-of-flight data is in the form of a burst of timing pulses, and wherein said oscillator is a dual frequency oscillator controlled by said logic circuit to generate said clock pulses at said high counting rate to increment said detonation counter up to said flight time count over the period of said timing pulse burst and then to generate said clock pulses at said low counting rate to decrement said detonation counter to zero.

19. The ammunition fuzing system defined in claim 17, wherein, prior to the transmission of said time-of-flight data in the form of a burst of timing pulses in number indicative thereof, said logic circuit transmits a calibration signal to said controller indicative of the frequency of said clock pulses and then controls said detonation counter to accumulate said timing pulses, thereby to register said flight time count.

20. The system defined in claim 19, wherein said logic circuit is connected with said detonation counter to detect the location of the most significant bit of said flight time count in said detonation counter, said logic circuit transmitting said conformation signal as a pair of echo pulses at a selected interval indicative of said most significant bit location.

* * * * *